United States Patent [19]

Reynolds

[11] 4,090,950

[45] May 23, 1978

[54] PROCESS FOR MANUFACTURING REFRIGERATION OILS

[75] Inventor: Ronald W. Reynolds, Wilmington, Del.

[73] Assignee: Sun Petroleum Products Company, Philadelphia, Pa.

[21] Appl. No.: 791,094

[22] Filed: Apr. 26, 1977

[51] Int. Cl.[2] ..... C10G 23/02; C10G 13/02; C10G 25/00

[52] U.S. Cl. ..... 208/89; 208/99

[58] Field of Search ..... 208/89, 210, 99, 28, 208/18

[56] References Cited

U.S. PATENT DOCUMENTS

| | | | |
|---|---|---|---|
| 3,189,540 | 6/1965 | Kozlowski et al. | 208/89 |
| 3,224,955 | 12/1965 | Anderson | 208/28 |
| 3,376,218 | 4/1968 | Menzl | 208/89 |
| 3,839,189 | 10/1974 | Mills et al. | 208/99 |
| 3,849,288 | 11/1974 | Milstein et al. | 208/99 |
| 3,941,680 | 3/1976 | Bryson et al. | 208/18 |

OTHER PUBLICATIONS

Bennett, R. N., and Elkes, G. J., "Low Pour Oils from Paraffinic Crudes by the BP Catalytic Dewaxing Process", presented at National Fuels and Lubricants Meeting, Nov. 6–8, 1974, Houston, Tex.

"Catalytic Dewaxing", Hydrocarbon Processing, Sep. 1976, p. 133.

*Primary Examiner*—George Crasanakis

*Attorney, Agent, or Firm*—J. Edward Hess; Donald R. Johnson; Paul Lipsitz

[57] ABSTRACT

A process for making refrigeration oils without acid treating and clay contacting steps which comprises subjecting a naphthenic oil to a first hydrogenation step at a temperature of from about 550° to about 660° F, a hydrogen pressure of from about 500 to about 1500 psig., and in the presence of a nickel-molybdenum or cobalt-molybdenum catalyst, subjecting the hydrogenated oil to a second hydrogenation treatment under the same conditions, catalytically dewaxing the twice hydrogenated oil and percolating the dewaxed oil through bauxite.

4 Claims, 3 Drawing Figures

PROCESS FOR MANUFACTURING REFRIGERATION OILS

Refrigeration oils are used in the refrigeration and air conditioning industry to provide lubrication for refrigeration compressors and they have been traditionally made from high quality naphthenic crudes. Two important properties of refrigeration oils are stability and low temperature floc point. The term stability applies to the oil's ability to remain chemically stable in the presence of other system components at elevated temperatures. A low temperature floc point requires that the oil be compatible with the refrigerant used in the compressor at the low temperatures of operation; i.e., the oil must not permit wax-like deposits to separate since they could clog the system.

Current processes for manufacturing refrigeration oils utilize acid contacting, clay contacting and hydrogenation steps.

Figure 1:
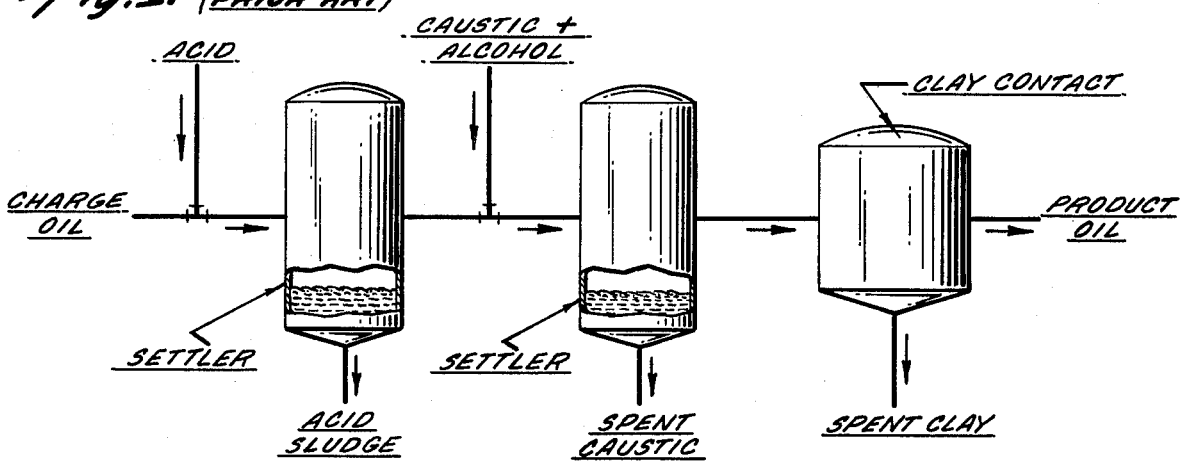
Fig. 1. (PRIOR ART)
FIG. 1 is a line drawing showing the process steps of a prior art acid-clay technique for making refrigeration oils.

The oldest method, using acid and clay, is shown in FIG. 1 and here the oil is contacted with 10–30 lbs/bbl 96% sulfuric acid. After withdrawing acid sludge, the oil is neutralized and contacted with 20–50 lbs/bbl attapulgus clay to make a final product. In a more recent variation shown in FIG. 2, the oil is first hydrogenated and then about 5 lbs/bbl acid is injected and the sour oil/acid mixture is clay contacted. The acid, hydrogenation and clay all affect the stability of the oil. The clay treatment reduces floc point.

These prior art processes have several problems, particularly of an ecological nature. The acid sludge, spent caustic and spent attapulgus clay which result from the prior art processes create serious disposal problems and expensive processing is required to make them ecologically acceptable. Also, these prior art processes require a large volume of clay to achieve the desired reduction in floc point and thus large amounts of waste are generated. Furthermore, the clay used in the final step is not regenerable and this results in an inefficient process as well as one that is ecologically unsound.

In the process of this invention these ecological problems are overcome since no acid, caustic or clay is used. In addition the process permits regeneration of a bauxite material used in the process for obtaining the desired chemical stability. Further, the process requires a low capital requirement because of its simplicity and yet provides a refrigeration oil not only meeting the requirements of stability and floc point, but also of a quality superior to that obtained by conventional processing.

Thus, in accord with the invention, a process is provided for making refrigeration oils without the prior art acid treating and clay contacting steps which comprises subjecting a naphthenic oil to a first hydrogenation step at a temperature of from about 550° to about 660° F, a hydrogen pressure of from about 500 to about 1500 psig., and in the presence of a nickel-molybdenum or cobalt-molybdenum catalyst, subjecting the hydrogenated oil to a second hydrogenation under the same conditions, catalytically dewaxing the twice hydrogenated oil and percolating the dewaxed oil through bauxite.

The usual charge stock to the process a high aromatic stock which is a blend of vacuum distillates from low wax content naphthenic crudes. It is known that low aromatic, paraffinic stocks have innately better oxidation and chemical stability and thus it is unexpected that a high aromatic stock can be processed to obtain a refrigerant oil with good low temperature properties. Typical U.S. Gulf Coast naphthenic crudes useful in the process are Miranda and Refugio Light. However, other U.S. naphthenic crudes and foreign crudes would also be suitable. Typical of a suitable blend of naphthenic distillates used as charge are:

| | |
|---|---|
| Viscosity, SUS at 100° F | 160 |
| Specific Gravity | .9280 |
| Viscosity Gravity Constant | .884 |
| Molecular Weight | 325 |
| Pour Point, ° F | −30 |
| Refractive Index | 1.5121 |
| Clay-gel analysis | Wt. % |
| Asphatenes | 0 |
| Polar | 1.8 |
| Aromatics | 44.0 |
| Saturates | 54.2 |
| Carbon Type Analysis | Wt. % |
| $C_A$ | 21 |
| $C_N$ | 37 |
| $C_P$ | 42 |

The process is also suitable for higher wax content crudes such as Nigerian medium or Trinidad Light since the wax will be removed catalytically.

Figure 2:
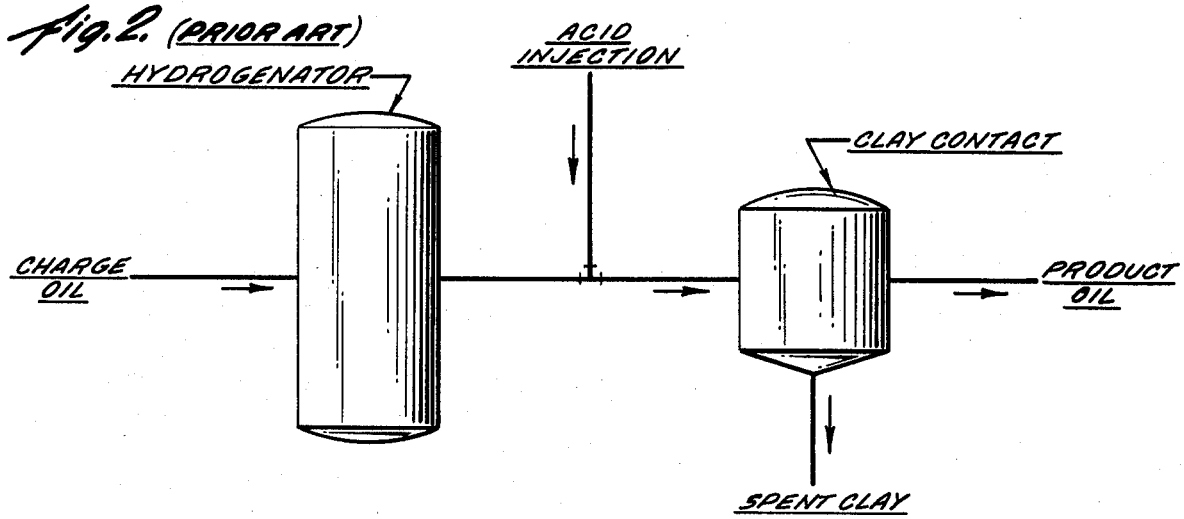
Fig. 2. (PRIOR ART)
FIG. 2 is a line drawing showing an alternate prior art process where hydrogenation, a small amount of acid injection, and clay treating are used.

The charge oil is subjected to a first hydrogenation step under conditions similar to those which would be used in the prior art process of FIG. 2. In general these hydrogenation conditions will be those shown in the following table:

| | Range | Preferred |
|---|---|---|
| Temperature, ° F | 550–660 | 580–620 |
| $H_2$ Pressure, psig | 500–1500 | 700–1000 |
| LHSV (Liq. hourly space vel.) | 0.25–2.0 | 0.5–1.0 |

It will be understood that this hydrogenation is a very mild treatment and effects very minor cracking, if any. The hydrogenation, as is indicated above, is carried out under mild conditions and will effect primarily the hydrogenation of nitrogen and sulfur compounds and saturation of multi-ring components of the oil. A minor amount of single ring saturation will also occur, but, as indicated, essentially no cracking will occur under the mild hydrogenation conditions used.

The catalyst used for hydrotreating will be a nickel-molybdenum or cobalt-molybdenum catalyst. A typical catalyst is Aero$^R$ HDS-9 Trilobe manufactured by American Cyanamid Co. which has the following analysis:

| | Wt. % |
|---|---|
| NiO | 3–4 |
| $MoO_3$ | 17.5–18.5 |
| $Na_2O$ | 0.04 max. |
| Fe | 0.05 max. |

After stripping out $H_2S$ and $NH_3$ compounds, the second hydrotreating step is carried out under the same conditions as the first step shown above.

After the second hydrogenation the oil is subjected to a catalytic dewaxing step to effect lowering of the floc point. Catalytic dewaxing is known in the art to reduce the pour point of middle distillates and light lubricating oil fractions and has been used for production of refrigeration oils (see Hydrocarbon Processing, Sept. 1976 p. 133) and reference is made to the detailed description by Bennett et al in Oil and Gas Journal, Jan. 6, 1975, pg. 69 as illustrative of the process conditions used. In this catalytic dewaxing step normal paraffins and nearly normal paraffins are preferentially cracked to gases and low boiling liquids which are removed by distillation. In general, the catalytic dewaxing step will be carried out over the operating parameters shown in the following table:

| Operating Conditions For Catalytic Dewaxing | Range | Preferred |
|---|---|---|
| Temperature, ° F | 525–775 | 575–725 |
| Hydrogen Pressure, PSIG | 200–1500 | 300–800 |
| LHSV | 0.5–10.0 | 1–4 |
| Hydrogen rate, SCF/bbl | 0–10,000 | 1000–3000 |

The catalyst used in the catalytic dewaxing step will be a crystalline mordenite of reduced alkali metal content; e.g. a decationized alumnio-silicate of the mordenite class. These catalysts are well known in the art; see for example Columns 2 and 3 of U.S. Pat. No. 3,902,988 where the preferred catalyst is disclosed as a platinum group metal on a decationized mordenite. Such catalysts are commercially available, as for example Zeolon H from the Norton Company.

After the dewaxing step, the oil is percolated over bauxite at the process parameters shown in the following table:

| | Range | Preferred |
|---|---|---|
| Temperature, ° F | 50–300 | 70–120 |
| Rate, Bbl. oil/Ton Bauxite/Hr. | 1–20 | 3–5 |
| Pressure psig | 0–100 | 0–40 |

This step is merely a mild clean-up and uses a relatively small amount of bauxite. In general the process yields about 150 to 200 barrels of oil per ton of bauxite. Overall yield of product oil from all steps of the process is about 80%.

Subsequent to the percolation step the oil is ready for use. The clay may be readily regenerated by roasting to drive off hydrocarbons when it no longer has the required absorption capacity.

It will be understood that the exact sequence of the two hydrogenting steps and catalytic dewaxing steps could be modified to fit physical requirements of a particular refiner.

As a result of the above processing, the resultant oil is a refrigeration oil that gives equivalent or superior performance to those refrigeration oils obtained by the conventional acid/attapulgus clay routes. It is entirely unexpected that two succesive hydrogenations at moderate conditions yield an oil which is amendable to a mild bauxite percolation for a significant floc point reduction.

In order to further illustrate the process of the invention the following examples are given. The stability and floc properties used to evaluate the product oils were evaluated by the well known sealed tube stability test and floc test. In the sealed tube stability test the oil in a sealed tube is subjected to an atmosphere of Refrigerant 12 and a Swedish-steel catalyst at 347° F for 14 days. At the end of the test, the amount of Refrigerant 22 formed is determined. The smaller the quantity formed, the better the stability of the oil. The floc test measures compatibility of the oil with refrigerant at low temperatures. The oil must not separate wax-like deposits which could clog a system. In the floc test, a 10% solution of the oil in Refrigerant 12 is cooled in a sealed tube and the temperature determined when deposits appear. The lower the temperature, the better.

EXAMPLE 1 (METHOD OF PRIOR ART)

A naphthenic oil was treated using steps outlined in FIG. 2, as follows. The oil was first hydrogenated at the following conditions:

| | |
|---|---|
| Reactor Temperature, ° F | 610 |
| Hydrogen Pressure, psig | 700 |
| LHSV | 0.5 |
| Catalyst (American Cyanamid) | HDS-9 Trilobe |

Properties of feed oil and hydrogenated oil may be contrasted as follows:

| | Feed | After Hydrogenating |
|---|---|---|
| 14 Day Sealed Tube Stability, % R22 | 11 | 5.2 |
| Floc Point, ° F | −30 | −30 |

5 lbs/bbl of 96% $H_2SO_4$ were injected to the oil and the oil was contacted with 35 lbs attapulgus clay/bbl oil for 20 minutes at 275°–300° F. The spent clay was then filtered from the oil. Finished oil sealed tube stability was 0.2–0.4 wt % R22 and floc point −60° F. Overall yields for the process were:

| | Vol. % of Charge |
|---|---|
| Finished Oil | 78.0 |
| Downgraded Hydrocarbons | 9.5 |
| Losses | 12.5 |

EXAMPLE 2 (METHOD OF INVENTION)

Figure 3:
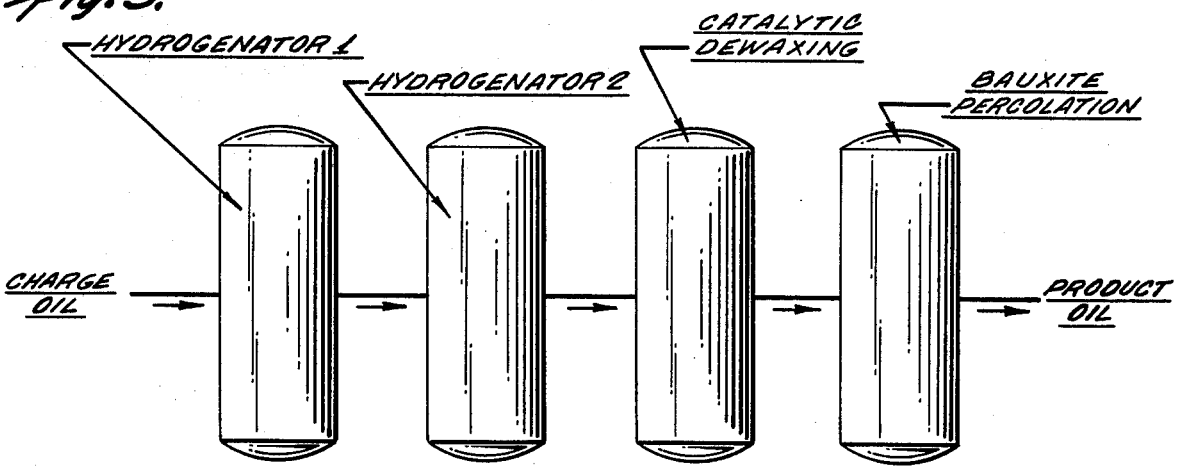
FIG. 3 is a line drawing showing the process of this invention.

The same naphthenic oil was processed in accord with the process steps of FIG. 3. Two successive hydrogenations were made as follows:

| | Feed | Hydrogenation 1 | Hydrogenation 2 |
|---|---|---|---|
| Operating Conditions | | | |
| Reactor Temperature, ° F | — | 617 | 617 |
| Hydrogen Pressure, psig | — | 700 | 700 |
| LHSV | — | 0.5 | 0.5 |
| Catalyst | — | American Cyanamid | HDS-9 Trilobe |
| Properties | | | |
| 14 Day Sealed Tube Stability, % R22 | 11 | 5.3 | 1.9 |
| Floc Point, ° F | −30 | −30 | −30 |

The hydrogenated oil was then catalytically dewaxed by mixing it with hydrogen and contacting with a catalyst at a LHSV of 4 and at elevated temperature and pressure. Normal paraffins and nearly normal paraffins which were preferentially cracked to gases and low boiling liquids were removed by distillation. Operating conditions were:

| | |
|---|---|
| Temperature, ° F | 575 |
| $H_2$ Pressure, psig | 800 |
| LHSV | 4 |
| $H_2$ Recycle, SCF/Bbl | 2000–4000 |

The catalyst used was a decationized alumino-silicate of the mordenite class (Zeolon H). One half percent by wt. platinum was added to the catalyst by evaporating from a water solution containing platinum diamino dinitrite. The catalytically dewaxed oil had sealed tube stability of 1.9 wt % R22 and floc point of less than −90° F.

Finally the oil was percolated over activated bauxite:

| | |
|---|---|
| Temperature | 70° F |
| Charge Rate | 4.2 Bbls Oil/Ton Bauxite/Hr |
| Charge/Cycle | 120 Bbls Oil/Ton Bauxite |

The final oil had a sealed tube stability of 0.1 wt % R22 and floc point of less than −90° F. Overall yields for this process were:

| | Vol % of Charge |
|---|---|
| Finished Oil | 78.0 |
| Downgraded Hydrocarbons | 22.0 |
| Losses | 0 |

It will be seen that the method of the invention yields a high quality refrigeration oil product having a sealed tube stability of 0.1% and a floc point of below −90° F. In contrast the prior art method yields an oil with a stability of 0.2 to 0.4% and a floc point of −60° F which is significantly inferior to the oil produced by the method of the invention.

The invention claimed is:

1. A process for making refrigeration oils without acid treating and clay contacting steps which comprises subjecting a high aromatic, low wax naphthenic oil to a first hydrogenating step at a temperature of from about 550° to 660° F, a hydrogen pressure of from about 500 to about 1500 psig, and in the presence of a nickel-molybdenum or cobalt-molybdenum catalyst, stripping out $H_2S$ and $NH_3$ from the hydrogenated oil from said first hydrogenating step, subjecting the hydrogenated oil to a second hydrogenating step with the same catalyst as in said first hydrogenating step and under the same conditions, catalytically dewaxing by hydrocracking the twice hydrogenated oil at a temperature of 525° F to 775° F at a hydrogen pressure of 200 to 1500 psig and in the presence of a catalyst comprising a platinum group metal on a crystalline mordenite of reduced alkali metal content, and percolating the dewaxed oil through bauxite.

2. The process of claim 1 wherein said naphthenic oil is a blend of vacuum distillates from low wax naphthenic crudes.

3. The process of claim 2 wherein said hydrogenating catalyst is a nickel-molybdenum catalyst.

4. The process of claim 3 where the two hydrogenating steps are carried out at a temperature of from about 580° to about 620° F, at a pressure of from about 700 to about 1000 psig and a LHSV of from about 0.5 to about 1.0.

* * * * *